US007103927B2

(12) United States Patent
Holub

(10) Patent No.: US 7,103,927 B2
(45) Date of Patent: Sep. 12, 2006

(54) COT THAT FOLDS INTO A COMPACT CONFIGURATION

(75) Inventor: Timothy M. Holub, Cheney, KS (US)

(73) Assignee: The Coleman Company, Inc., Wichita, KS (US)

( * ) Notice: Subject to any disclaimer, the term of this patent is extended or adjusted under 35 U.S.C. 154(b) by 57 days.

(21) Appl. No.: 10/943,446

(22) Filed: Sep. 17, 2004

(65) Prior Publication Data

US 2006/0059620 A1 Mar. 23, 2006

(51) Int. Cl.
*A47C 17/64* (2006.01)

(52) U.S. Cl. ..... 5/111; 5/112; 5/114

(58) Field of Classification Search ..... 5/110–112, 5/114, 116, 117, 154
See application file for complete search history.

(56) References Cited

U.S. PATENT DOCUMENTS

| | | | | | |
|---|---|---|---|---|---|
| 32,884 | A | | 7/1861 | Mettam | |
| 37,153 | A | | 12/1862 | Cross | |
| 228,920 | A | | 6/1880 | Murray et al. | |
| 280,004 | A | * | 6/1883 | Bakewell | 297/18 |
| 417,161 | A | | 12/1889 | Fortenbaugh | |
| 551,259 | A | | 12/1895 | Calkins | |
| 712,203 | A | * | 10/1902 | Pellettieri et al. | 5/111 |
| 793,723 | A | | 7/1905 | Herman | |
| 822,369 | A | | 6/1906 | Hodson | |
| 826,590 | A | | 7/1906 | Miller | |
| 1,097,100 | A | | 5/1914 | Kallio | |
| 1,185,568 | A | | 5/1916 | Zeunert | |
| 1,224,782 | A | | 5/1917 | Pedersen | |
| 1,250,201 | A | | 12/1917 | Metzger et al. | |
| 1,269,641 | A | | 6/1918 | Peterson | |
| 1,278,604 | A | * | 9/1918 | Darling | 5/112 |
| 1,300,872 | A | * | 4/1919 | Purcell | 5/114 |
| 1,328,977 | A | * | 1/1920 | Basford | 5/112 |
| 1,335,548 | A | * | 3/1920 | Basford | 5/112 |
| 1,359,844 | A | * | 11/1920 | Salle et al. | 5/112 |
| 1,367,465 | A | * | 2/1921 | Coray | 5/119 |
| 1,483,979 | A | | 2/1924 | Luery | |
| 1,503,391 | A | * | 7/1924 | Teske | 5/119 |
| 1,574,696 | A | | 2/1926 | Roberts | |
| 1,577,204 | A | | 3/1926 | Davis | |
| 1,577,205 | A | | 3/1926 | Davis | |
| 1,586,355 | A | * | 5/1926 | Defranco | 5/111 |
| 1,608,291 | A | * | 11/1926 | Basford | 5/112 |

(Continued)

FOREIGN PATENT DOCUMENTS

| | | |
|---|---|---|
| WO | WO 99/09863 | 3/1999 |
| WO | WO 02/47515 | 6/2002 |

*Primary Examiner*—Robert G. Santos
(74) *Attorney, Agent, or Firm*—Leydig, Voit & Mayer, Ltd.

(57) ABSTRACT

A cot having a frame that is configured so that one end, such as the head end of the cot, is recessed within the other end, i.e., the foot end of the cot, when the cot is folded. As an example, the legs of one end may recess into the legs of the other end. To this end, the bifold cot may include a head portion having a tapered section forming a narrowed head end. This narrowed head end, or a leg or legs associated therewith, is received within the frame (or associated legs) for the foot portion of the bifold cot when the bifold cot is folded. A trifold cot is also provided that also has an extension that may be folded against the head portion, and the extension and the head portion may be folded and recessed at least partly within the frame at the foot portion.

23 Claims, 4 Drawing Sheets

U.S. PATENT DOCUMENTS 1,622,188 A * 3/1927 Edwards ..... 5/114
1,642,140 A 9/1927 Cane et al.
1,776,286 A 9/1930 Jasinski
1,788,919 A 1/1931 Lansberry et al.
2,112,454 A 3/1938 Davis
2,128,018 A * 8/1938 Skidmore ..... 5/114
2,154,557 A 4/1939 Bechik
2,279,852 A * 4/1942 Webster ..... 297/19
2,334,014 A * 11/1943 Koster ..... 5/111
2,371,481 A * 3/1945 Terrell ..... 190/2
2,562,197 A * 7/1951 Martin ..... 5/38
2,579,263 A 12/1951 Kroha
2,581,623 A 1/1952 Benjamin
2,888,689 A 6/1959 Mourot
2,938,572 A * 5/1960 Solloway et al. ..... 297/296
3,123,395 A 3/1964 Glass
3,136,272 A 6/1964 Sprigman
3,350,726 A 11/1967 Gardner
3,430,273 A 3/1969 Stillwaugh
3,601,826 A 8/1971 Smith
3,822,422 A * 7/1974 Buntyn ..... 5/114
3,828,992 A * 8/1974 Cerchione ..... 224/156
3,967,330 A 7/1976 Zawadowsky
4,017,919 A 4/1977 Hemmeter
4,143,434 A 3/1979 Monot
4,199,831 A 4/1980 Müller
4,317,244 A 3/1982 Balfour-Richie
4,384,379 A 5/1983 Yamada
4,454,615 A 6/1984 Whitney
4,579,066 A 4/1986 Zeigler
4,635,305 A 1/1987 Wyss
4,694,515 A 9/1987 Rogers, Jr.
5,090,071 A 2/1992 Bathrick et al.
5,097,552 A 3/1992 Viesturs
5,210,888 A 5/1993 Canfield
5,218,729 A 6/1993 Walton
5,388,293 A 2/1995 Kistner
5,513,402 A 5/1996 Schwartz
5,608,930 A 3/1997 Chen
5,651,153 A 7/1997 Goodrich
6,006,383 A 12/1999 Pile et al.
6,073,894 A 6/2000 Chen
6,125,488 A 10/2000 Vogland et al.
6,134,727 A 10/2000 Hwang
6,151,730 A 11/2000 Weston
6,199,235 B1 3/2001 Spahn et al.
6,234,089 B1 5/2001 Zheng et al.
6,253,396 B1 7/2001 Weston
6,364,410 B1 4/2002 Tang
6,446,282 B1 9/2002 Wu
6,457,192 B1 10/2002 Choi et al.
6,505,565 B1 1/2003 Byung et al.
2001/0013145 A1 8/2001 Elliot et al.
2002/0016992 A1 2/2002 Weston
2002/0124310 A1 9/2002 Takeuchi
2003/0019033 A1 1/2003 Choi
2006/0000020 A1* 1/2006 Matheus et al. ..... 5/110
2006/0059620 A1* 3/2006 Holub ..... 5/114

* cited by examiner

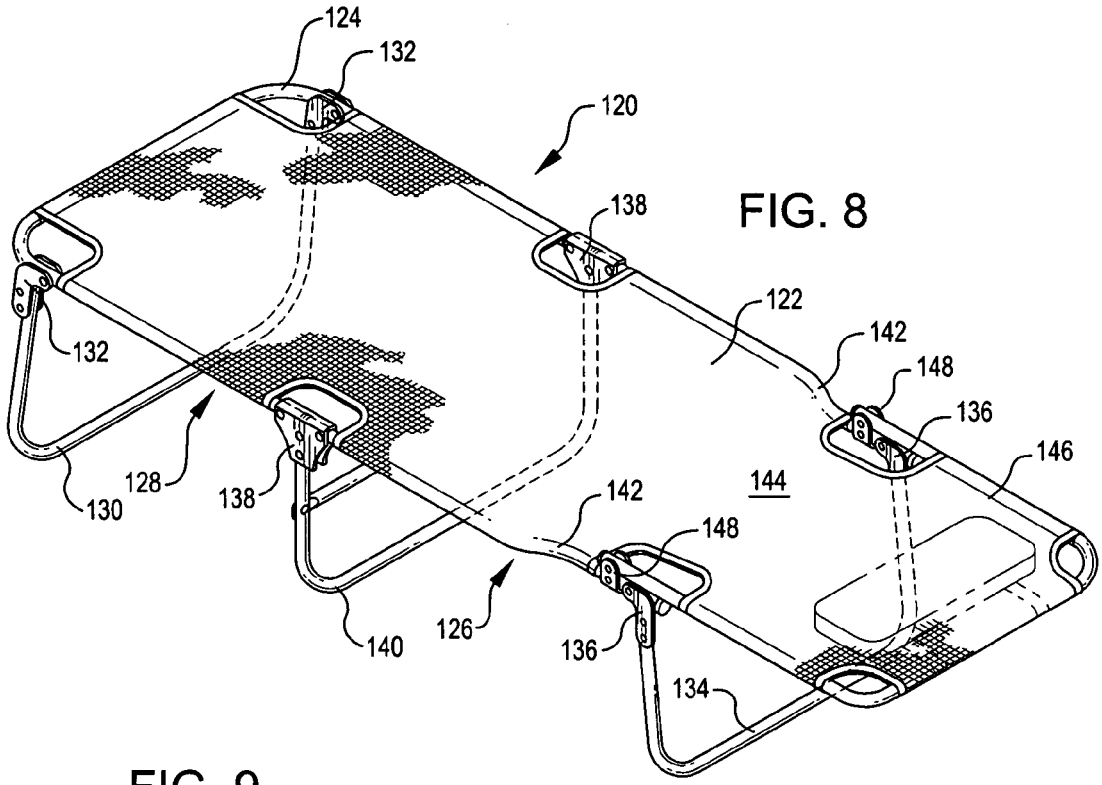
FIG. 8
FIG. 9
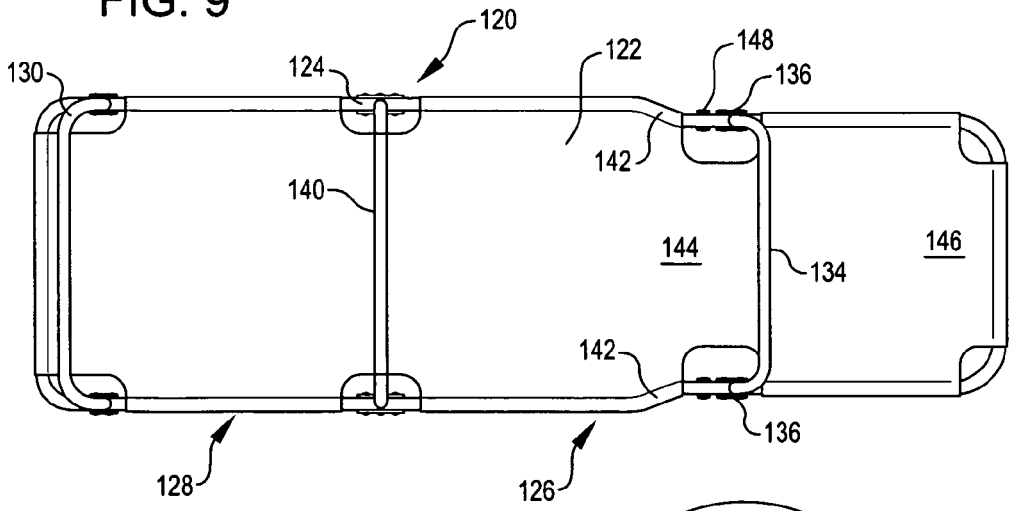
FIG. 10
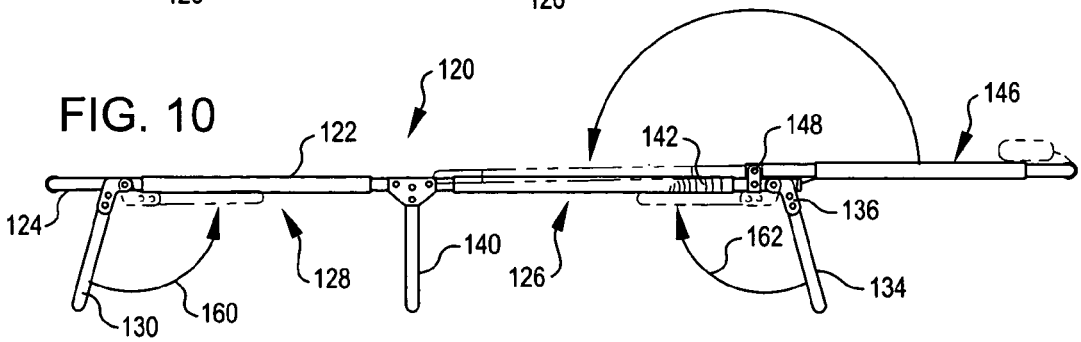

COT THAT FOLDS INTO A COMPACT CONFIGURATION

TECHNICAL FIELD OF THE INVENTION

The present invention is directed to portable beds, and more specifically to cots.

BACKGROUND OF THE INVENTION

In general, a cot is a collapsible bed, typically formed of fabric stretched on a frame. One example of a cot includes U-shaped legs attached to a frame. A canvas covering extends over the frame. Hinges are provided at the center of the cot for folding the cot in half in a manner known in the art. When folding such a cot, the legs fold inward underneath the tubing for cot frame, and the cot frame folds in half so that the U-shaped legs on opposite ends of the cot frame align against one another. Thus, in a folded configuration, the cot has a thickness of the outer tubing of the head end of the cot, the legs at the head end of the cot, the legs at the foot end of the cot, and the outer tubing for the foot end of the cot.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, a bifold cot is provided having a frame that is configured so that one end, such as the head end of the cot, is recessed within the other end, i.e., the foot end of the cot, when the cot is folded. As an example, the legs of one end may recess into the legs of the other end. To this end, the bifold cot may include a head portion having a tapered section forming a narrowed head end. This narrowed head end, or a leg or legs associated therewith, is received within the frame for the foot portion of the bifold cot when the bifold cot is folded. As such, the bifold cot is capable of being folded to a more compact configuration than prior art cots.

In accordance with another embodiment, a trifold cot is provided that also has a tapered portion. The trifold cot additionally includes an extension. The extension also has a width that is narrower than the frame of the trifold cot at the foot portion. In this manner, the extension may be folded against the head portion, and the extension and the head portion may be folded and recessed at least partly within the frame at the foot portion of the cot. In this manner, the trifold cot may also be folded more compactly than prior art cots.

Other features of the invention will become apparent from the following detailed description when taken in conjunction with the drawings, in which:

BRIEF DESCRIPTION OF THE DRAWINGS

FIG. 8 is a side perspective view of a trifold cot in accordance with an embodiment;

FIG. 9 is a bottom view of the trifold cot of FIG. 8;

FIG. 10 is a side view of the trifold cot of FIG. 8;

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
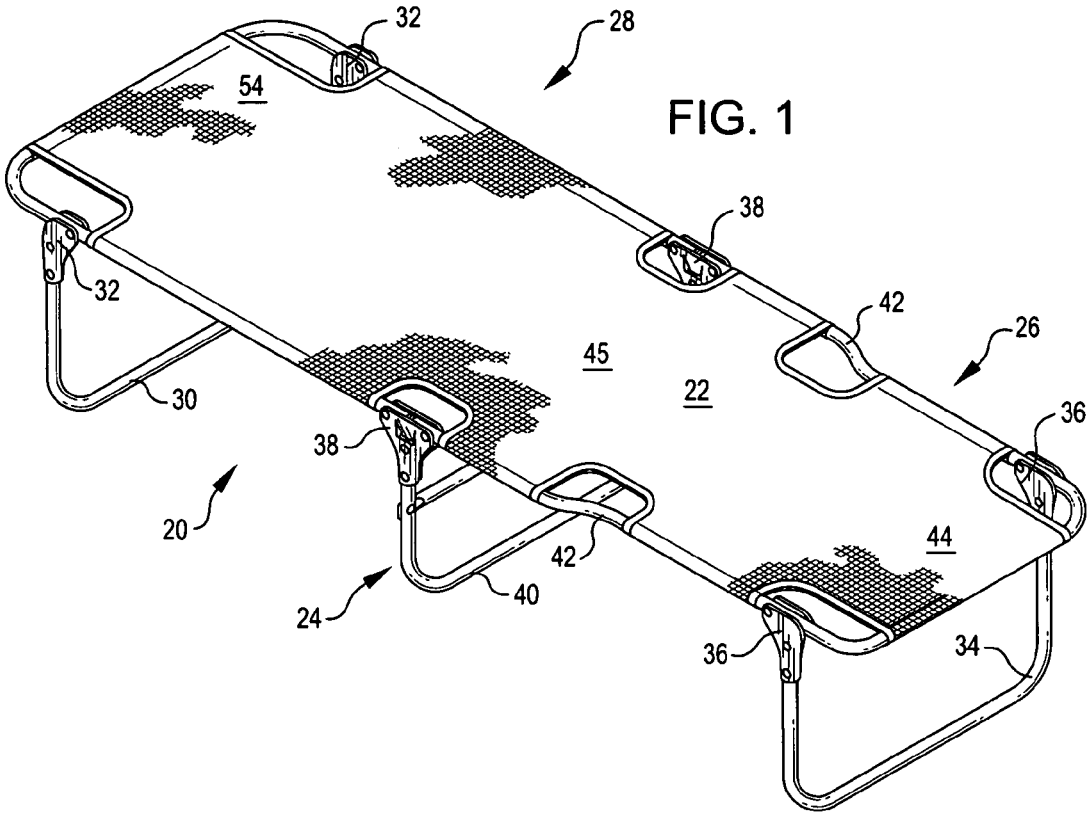
FIG. 1 is a side perspective view of a bifold cot in accordance with an embodiment.
Figure 2:
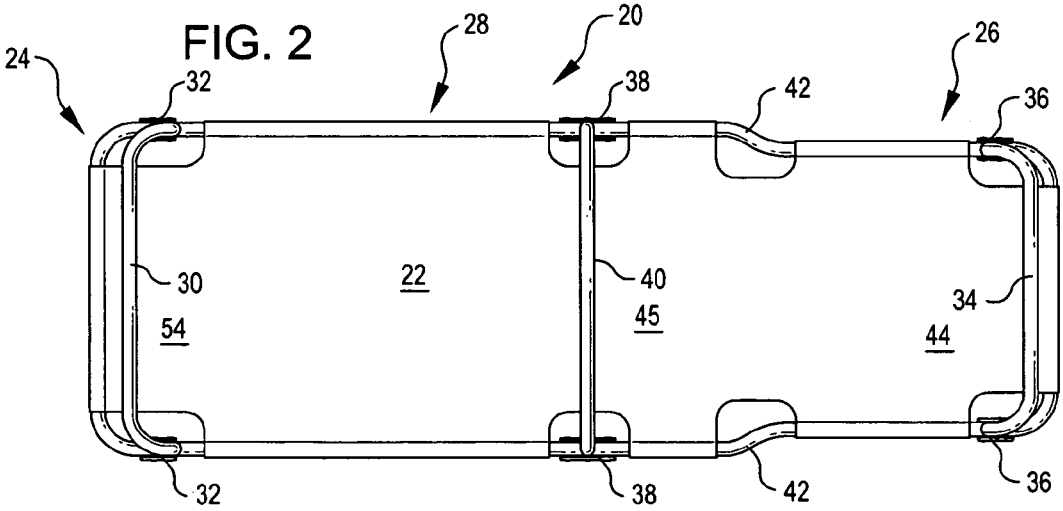
FIG. 2 is a bottom view of the bifold cot of FIG. 1.

Referring now to the drawings, in which like reference numerals represent like parts throughout the several views, FIG. 1 shows a bifold cot 20 in accordance with an embodiment. The terms "bifold cot" as used herein are meant to denote a cot that can be folded a single time to create two hingely fastened sections of equal length or unequal length. The bifold cot 20 includes fabric 22 stretched across a frame 24. The fabric 22 may be any suitable material, and in one example is canvas. The frame is typically formed of a rigid material, such as wood, or a tubular metal, such as steel or aluminum.

The bifold cot 20 includes a head portion 26 (to the right in FIG. 1) and a foot portion 28 (to the left in FIG. 1). These designations are given for convenience of description, and a cot in accordance with different embodiments may be arranged just opposite that described (i.e., with the head portion to the left), or in multiple different ways.

A foot end U-shaped leg 30 is attached toward the end of the foot portion 28 via hinges 32. Similarly, a head end U-shaped leg 34 is attached at an outer end of the head portion 26 via hinges 36.

The foot portion 28 is connected to the head portion 26 via central hinges 38. Center legs 40 extend downward from the central hinges 38 in a manner known in the art.

In accordance with an embodiment, the head portion 26 includes a tapered section 42 at which the width of the head portion 26 decreases. In the embodiment shown, for the tapered section 42, the width of the head portion 26 is greater adjacent to the central hinges 38 than at an outer portion of the head portion 26. To this end, a head end 44 of the head portion 26 has a narrowed width with respect to a central section 45 of the head portion 26.

Figure 4:
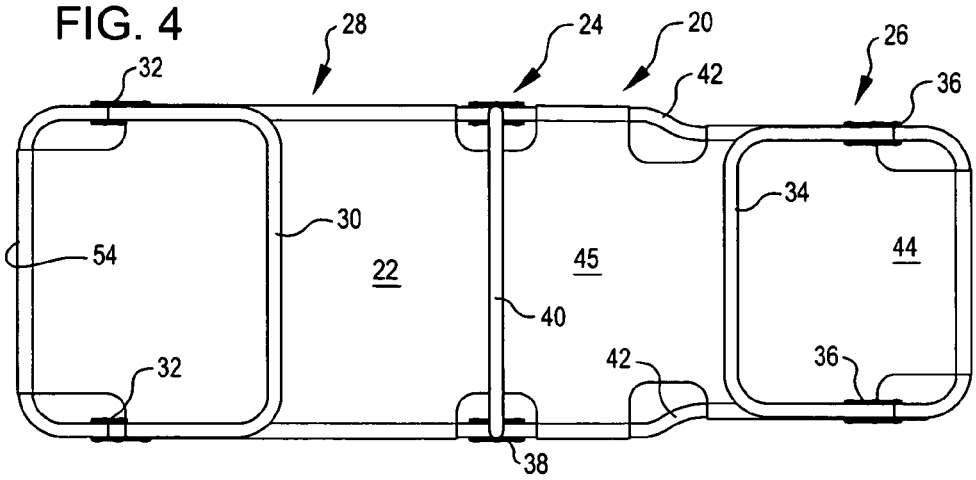
FIG. 4 is a bottom of the bifold cot of FIG. 1, shown in a partial stage of folding.
Figure 5:
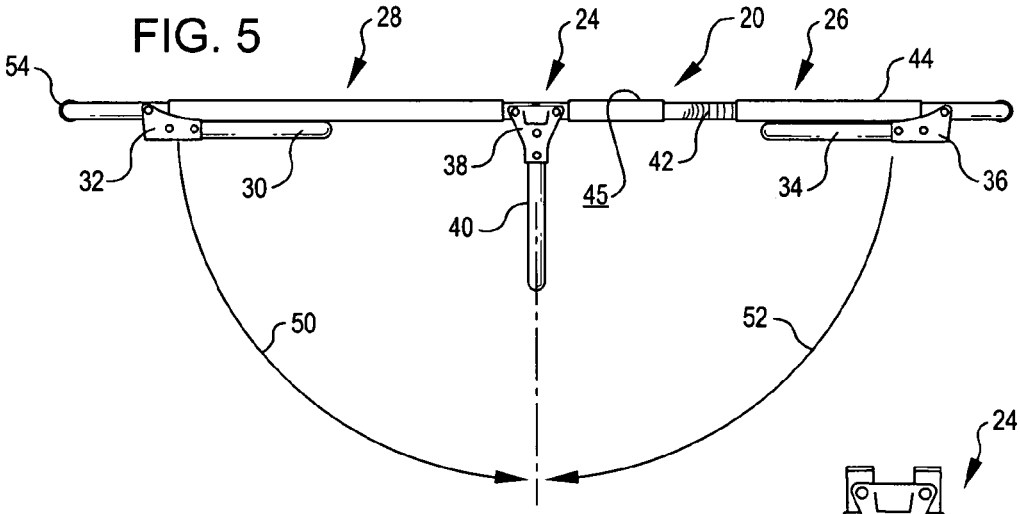
FIG. 5 is a side view of the bifold cot of FIG. 4.

In accordance with an embodiment, the narrowed head end 44 provides advantageous compact folding of the bifold cot 20. A folding sequence for the bifold cot 20 is shown in FIGS. 3—5.

Figure 3:
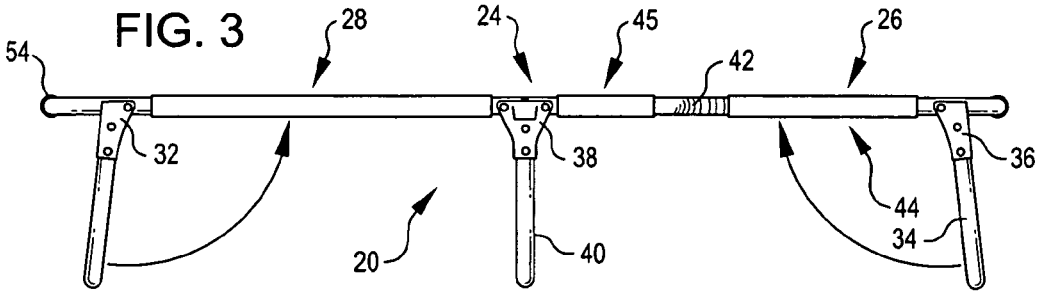
FIG. 3 is a side view of the bifold cot of FIG. 1.

Beginning at FIG. 3, the foot end U-shaped leg 30 and the head end U-shaped leg 34 are folded to underneath the frame 24, against the underside of the respective foot and head portions 28, 26. With the foot end U-shaped leg 30 and the head end U-shaped leg 34 in the folded positions (FIG. 5), the foot and head portions 28, 26 are folded toward one another, downward with respect to an upper surface of the bifold cot 20. This folding action is shown by the arrows 50, 52 in FIG. 5.

Figure 6:
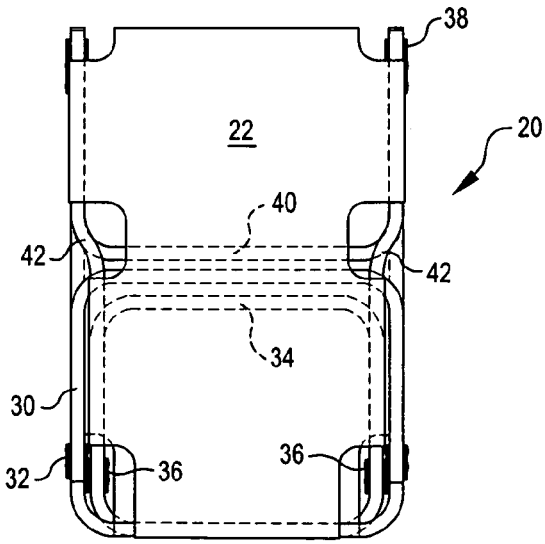
FIG. 6 is a front view of the bifold cot of FIG. 1, shown in a folded configuration.
Figure 7:
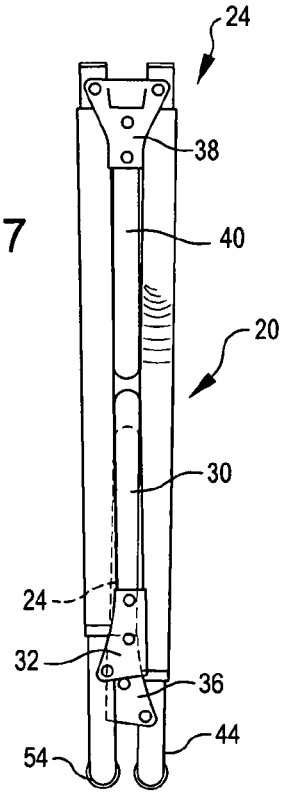
FIG. 7 is a side view of the bifold cot of FIG. 6.
Figure 11:
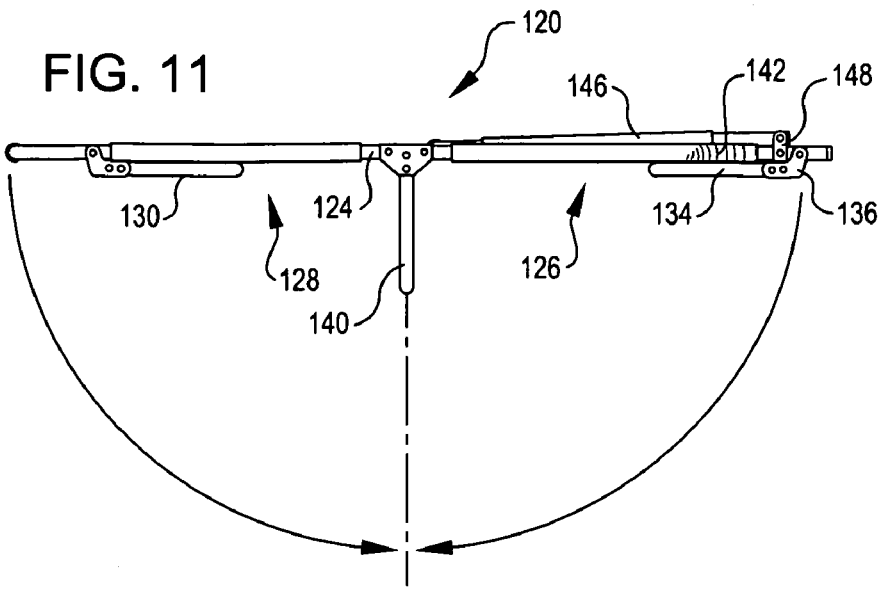
FIG. 11 is a side view of the trifold cot of FIG. 8, shown in a partial stage of folding.

When the bifold cot 20 is folded, in accordance with an embodiment, the narrowed head end 44 fits within the frame 24 at a foot end 54 of the foot portion 28. In the embodiment shown in FIG. 6, the head end U-shaped leg 34 are received within the foot end U-shaped leg 30, and partially within the frame 24 at the foot end 54 of the foot portion 28. Because the head end 44 of the head portion 26 is narrower than the frame 24 at the foot end 54 of the foot portion 28, this compact folding arrangement is permitted. This positioning is shown in FIGS. 6 and 7. Although the head end U-shaped leg 34 are received within the foot end U-shaped leg 30 and the frame 24 at the foot end 54 in the embodiment shown, the frame at the head end 44 of the head portion 28 may also be received within the foot end U-shaped leg 30 and/or the frame 24 at the foot end 54.

Recessing the head end U-shaped leg 34 into the foot end U-shaped leg 30 and/or the frame 24 at the foot end 54 of the foot portion 28 permits compact folding of the bifold cot 20. As can be seen, the foot end 54 and the head end 44 are aligned very closely to one another in FIG. 7, with movement relative to one another constrained only by the fact that the foot end U-shaped leg 30 is received between the outer portions of the frame 24 at the head portion 26 and foot portion 28. This compact folded configuration is substantially less than prior art cots, in which the cots are typically a thickness of the head portion, the foot portion, and the foot and head end U-shaped legs.

The compact folding arrangement permits the bifold cot 20 to be stored in a smaller container, and permits more bifold cots 20 to be shipped in a particular container. As such, the configuration saves shipping costs and thus overall costs of the bifold cot 20.

A trifold cot 120 in accordance with an embodiment is shown in FIG. 8. The terms "trifold cot" as used herein are meant to denote a cot that can be folded two times to create three hingely fastened sections of equal length or unequal length. Like the bifold cot 20, the trifold cot 120 includes fabric 122 stretched over a frame 124. A head portion 126 is aligned opposite a foot portion 128. The foot portion 128 includes a foot end U-shaped leg 130 attached at hinges 132. Similarly, the head portion 126 includes a head end U-shaped leg 134 attached at a head end 144 of the head portion 126. However, unlike the bifold cot 20, the head end 144 of the trifold cot 120 is shortened and an extension 146 is attached at the head end 144 by hinges 148. In accordance with an embodiment, the extension 146 in the embodiment of the trifold cot 120 shown in the drawings is the same width as the narrowed head end 144 of the head portion 126. In use, the extension 146 may be folded outward so that it may rest on outer portions of the shortened head end 144. In addition, if desired, the position of the extension 146 may be adjustable to permit a user to recline at a particular angle in a manner known in the art.

To fold the trifold cot 120, the extension 146 is folded over a top portion of the head portion 126. The foot end and head end U-shaped legs 130, 134 are then folded in the same manner as described above with respect to the bifold cot 20. This folding is shown by the arrows 160, 162 in FIG. 10.

The head portion 126 and the foot portion 128 are then folded together in much the same manner as the bifold cot 20. When folded together, as with the bifold cot 20, the foot and head portions 128, 126 of the trifold cot 120 are arranged so that the head end U-shaped leg 134 may recess within the foot end U-shaped leg 130. Thus, like the bifold cot 20, the head portion 126 and the foot portion 128 may be compactly folded. Moreover, because the trifold cot 120 is provided in three foldable sections (i.e., the head portion 126, the foot portion 128, and the extension 146), the trifold cot 120 may be folded into a configuration resulting in a cot that is advantageously shorter than the folded bifold cot 20, in accordance with an embodiment.

Figure 13:
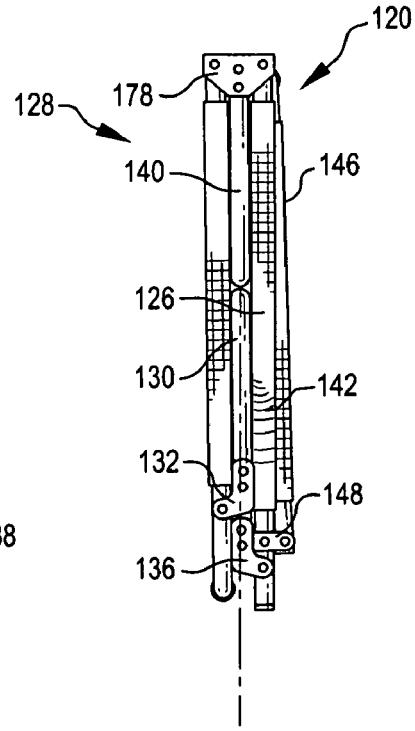
FIG. 13 is a side view of the trifold cot of FIG. 12.
Figure 12:
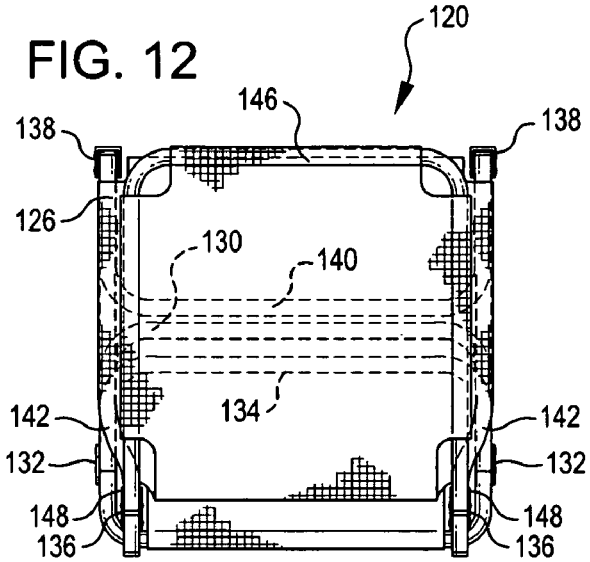
FIG. 12 is a front view of the trifold cot of FIG. 8, shown fully folded.

Moreover, because the extension 146 is narrower than the central section 145 of the head portion 126, the extension 146 may partially recess against the top surface of the head portion 126. That is, the frame for the extension 146, when folded into a storage configuration, extends against the fabric 122 and not against the frame 128 of the trifold cot 120. Because the fabric 122 is flexible, the extension 146 may fold more tightly against the rest of the trifold cot 120, as is shown in FIG. 13.

Although the bifold cot 20 and the trifold cot 120 are described with reference to a head end being narrower than a foot end, such a description is for convenience only. It is to be understood that a user may position his or her head at either end of either cot. Moreover, although the trifold cot 120 includes the extension 146 at the head portion 126, an extension may alternatively or additionally be provided at the foot portion 128.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A cot, comprising:

a first end, at least a portion of which has a first width, the first end comprising at least one first leg hinged thereto; and a second end, at least a portion of which has a second width, the second width being less than the first width, the second end comprising at least one second leg hinged thereto;

the first end being hinged to the second end so that the first and second ends are foldable against one another, said at least one first leg and said at least one second leg being configured and arranged so that at least a portion of one of said at least one first leg and said at least one second leg extends adjacent to and is received within the other of said at least one first leg and said at least one second leg when the first end and second end are folded against one another.

2. The cot of claim 1, wherein said at least one second leg is at least partly received within said first end when the first end and second end are folded against one another.

3. The cot of claim 2, wherein said at least one second leg comprises a U-shaped leg.

4. The cot of claim 1, wherein the second end comprises a tapered section wherein the width of the second end decreases from a wider width to the second width.

5. The cot of claim 4, wherein a portion of the second end having the wider width is adjacent to a hinge location for the first and second ends of the cot.

6. The cot of claim 4, wherein the wider width is substantially equal to the first width.

7. The cot of claim 5, wherein the cot is a trifold cot.

8. The cot of claim 7, wherein the trifold cot comprises an extension hinged to the second end.

9. The cot of claim 8, wherein the extension comprises a third width that is less than the first width, wherein the extension is foldable against the portion of the second end having the wider width and is received thereby.

10. The cot of claim 1, wherein the second end is a head end of the cot.

11. A cot, comprising:

a first end, at least a portion of which has a first width; and a second end, at least a portion of which has a second width, the second width being less than the first width, the second end comprising at least one leg hinged thereto, and wherein said at least one leg is at least partly received within said first end when the first end and second end are folded against one another; and the first end being hinged to the second end so that the first and second ends are foldable against one another, the first width and the second width being configured and arranged so that at least a portion of the second end is received within at least a portion of the first end when the first end and second end are folded against one another;

wherein the first end comprises a U-shaped leg hinged thereto, and wherein said at least one leg is at least partly received within said U-shaped leg when the first end and second end are folded against one another.

12. The cot of claim 11, wherein said at least one leg comprises a U-shaped leg.

13. A cot, comprising:

a first end, at least a portion of which has a first width, the first end having at least one first leg hinged thereto; and a second end, comprising:

a first section, hinged to the first end at a hinged attachment, at least a portion of the first section having a second width;

a second section, at least a portion of which has a third width, the third width being less than the first width;

at least one second leg hinged thereto;

the first and second ends being foldable against one another via the hinged attachment while said at least one first leg and said at least one second leg are folded against the first end and second section, respectively, said at least one first leg and said at least one second leg being configured and arranged so that at least a portion of one of said at least one first leg and said at least one second leg extends adjacent to and is received within at least a portion of the other of said at least one first leg and said at least one second leg when the first end and second end are folded against one another.

14. The cot of claim 13, wherein said at least one second leg is at least partly received within said first end when the first end and second end are folded against one another.

15. The cot of claim 13, wherein said at least one second leg comprises a U-shaped leg.

16. The cot of claim 13, wherein the second end comprises a tapered section between the first section and the second section.

17. The cot of claim 13, wherein the second width is substantially equal to the first width.

18. The cot of claim 13, wherein the cot is a trifold cot.

19. The cot of claim 18, wherein the trifold cot comprises an extension hinged to the second section.

20. The cot of claim 19, wherein the extension is foldable against the first section and is received thereby.

21. The cot of claim 13, wherein the second end is a head end of the cot.

22. A cot, comprising:

a first end, at least a portion of which has a first width, the first end having at least one first leg hinged thereto; and a second end, comprising:

a first section, hinged to the first end at a hinged attachment, at least a portion of the first section having a second width;

a second section, at least a portion of which has a third width, the third width being less than the first width;

at least one second leg hinged thereto, said at least one second leg being at least partly received within said first end when the first end and second end are folded against one another;

the first and second ends being foldable against one another via the hinged attachment while said at least one first leg and said at least one second legs are folded against the first end and second section, respectively, the first width and the third width being configured and arranged so that at least a portion of the second section is received within at least a portion of the first end when the first end and second end are folded against one another;

wherein said at least one first leg comprises a U-shaped leg, and wherein said at least one second leg is at least partly received within said U-shaped leg when the first end and second end are folded against one another.

23. The cot of claim 22, wherein said at least one second leg comprises a U-shaped leg.

* * * * *